US009091283B2

(12) United States Patent
Cannata et al.

(10) Patent No.: US 9,091,283 B2
(45) Date of Patent: Jul. 28, 2015

(54) PASSIVE PISTON UNIT

(75) Inventors: Antonio Cannata, London (CA); Reini Strasser, Iona Station (CA)

(73) Assignee: Tonand Brakes Inc., London (CA)

( * ) Notice: Subject to any disclaimer, the term of this patent is extended or adjusted under 35 U.S.C. 154(b) by 494 days.

(21) Appl. No.: 13/534,717

(22) Filed: Jun. 27, 2012

(65) Prior Publication Data

US 2012/0260794 A1 Oct. 18, 2012

Related U.S. Application Data

(63) Continuation-in-part of application No. 13/037,700, filed on Mar. 1, 2011, now Pat. No. 8,746,128.

(60) Provisional application No. 61/501,376, filed on Jun. 27, 2011.

(51) Int. Cl.
*F15B 1/04* (2006.01)

(52) U.S. Cl.
CPC ..... *F15B 1/04* (2013.01); *F15B 2201/21* (2013.01); *F15B 2201/31* (2013.01)

(58) Field of Classification Search
CPC ..... F15B 1/04; F15B 2201/21; F15B 2201/31
USPC ..... 92/132, 133, 134, 135, 130 A, 130 B; 60/562
See application file for complete search history.

(56) References Cited

U.S. PATENT DOCUMENTS

| | | | | | |
|---|---|---|---|---|---|
| 3,064,432 | A | * | 11/1962 | Shutt | 60/562 |
| 4,344,353 | A | * | 8/1982 | Duff et al. | 92/134 |
| 4,784,371 | A | * | 11/1988 | Kamper | 254/93 H |
| 5,802,638 | A | * | 9/1998 | Parker et al. | 60/469 |
| 6,085,501 | A | * | 7/2000 | Walch et al. | 92/134 |

* cited by examiner

*Primary Examiner* — Thomas E Lazo
(74) *Attorney, Agent, or Firm* — Grant Tisdall; Gowling Lafleur Henderson LLP

(57) ABSTRACT

A piston unit is disclosed that utilizes an elastic volume to store and release energy with each stroke by varying the hydraulic fluid volumes in and out of the hydraulic unit.

15 Claims, 9 Drawing Sheets

PASSIVE PISTON UNIT

CROSS-REFERENCE

This application is a continuation in part of U.S. patent application Ser. No. 13/037,700 filed Mar. 1, 2011 and claims the benefit of U.S. Provisional Application No. 61/501,376 filed Jun. 27, 2011 under 35 USC §119, both herein incorporated by reference.

FIELD OF THE INVENTION

The present disclosure relates to the field of hydraulic piston operated devices, and in particular the pistons used in such devices.

BACKGROUND OF THE INVENTION

Traditional braking such as drum or disc braking systems have been widely used in a range of vehicle applications. However, brake fade caused when the drums or discs and the linings of the brakes overheat from excessive use become particularly problematic in large vehicle applications. Traditional braking systems usually require regular maintenance to service and replace consumable components, such as brake pads. Large vehicles such as rail cars, semi-trailer trucks, waste collection vehicles, construction vehicles and other large multi-axle vehicles require considerable braking power to adequately control braking, particularly when the vehicle is carrying a load. Reliability of braking systems can have significant implications in terms of safety and cost.

As an alternative to traditional friction resistance brakes, liquid resistance or direct hydraulic braking have been used which do not rely on friction to transmit braking force. However, these systems have been limited in application due to sizes required to achieve the desired braking efficiency and modulation capability. The use of a hydraulic pump in direct hydraulic braking, having a reciprocating piston, can require significant fluid displacement to achieve desired brake horse power (BHP). However, the relatively large displacement required to achieve high braking can impact the design of piston units, for example requiring larger sized units due to larger bores and/or increased stroke lengths, thus limiting their application.

SUMMARY OF THE INVENTION

There is a need for a compact piston unit that provides improved hydraulic performance.

The present invention provides a piston unit that uses a resilient element to store energy and then releases the energy with each stroke.

In one embodiment, the present invention provides a piston unit comprising a main body having a bore located therein, the bore having a first end and a second end. A first piston is received within the bore and is operable to reciprocate within it. A second piston is received within the bore between the first piston and the second end of the bore, the second piston being operable to reciprocate within the bore. The second piston and the second end of the bore define a first cavity therebetween and the first and second piston define a second cavity therebetween. The piston unit also includes a resilient element, located in one of the first cavity and the second cavity. The resilient element is operable to bias the second piston towards the first piston when located in the first cavity and is operable to bias the second piston away from the first piston when located in the second cavity.

In an alternative embodiment, the other of the first cavity and the second cavity is configured to receive pressurized hydraulic fluid through a fluid port located in the cavity.

In one embodiment, the resilient element is connected to a resilience control unit for varying the resistance of the resilient element.

In one embodiment, the resilient element is a compressible medium that is operable to convert kinetic energy to potential energy. In another embodiment the resilient element is a spring.

In an alternative embodiment, the bore located in the piston unit has a non-linear configuration.

In an alternative embodiment, the first and second pistons reciprocate along the same axis within the bore. In another embodiment, each of the first and second pistons reciprocate along axes that are parallel to each other. In an alternative embodiment the first piston reciprocates along a first axis within the bore and the second piston reciprocates along a second axis within the bore, the first and second axis being non-parallel. In an alternative embodiment, the first and second axis are at 90° relative to each other.

BRIEF DESCRIPTION OF THE DRAWINGS

The present invention will now be described in further detail with reference to the following figures:

FIGS. 4A, 4$A_1$ and 4$A_2$ are schematic diagrams showing the oil ejection phase under low injection pressure for one embodiment of the piston unit described herein;

FIGS. 5C, 5$C_1$ and 5$C_2$ are schematic diagrams showing the oil ejection phase under high injection pressure for one embodiment of the piston unit described herein;

DETAILED DESCRIPTION OF THE PREFERRED EMBODIMENTS

The present invention relates to a piston unit for use in a pump/motor. Examples of the use of such pump/motors may include, but are note limited to, in a brake system.

The present invention will now be described in detail with reference to the accompanying Figures.

Figure 1:
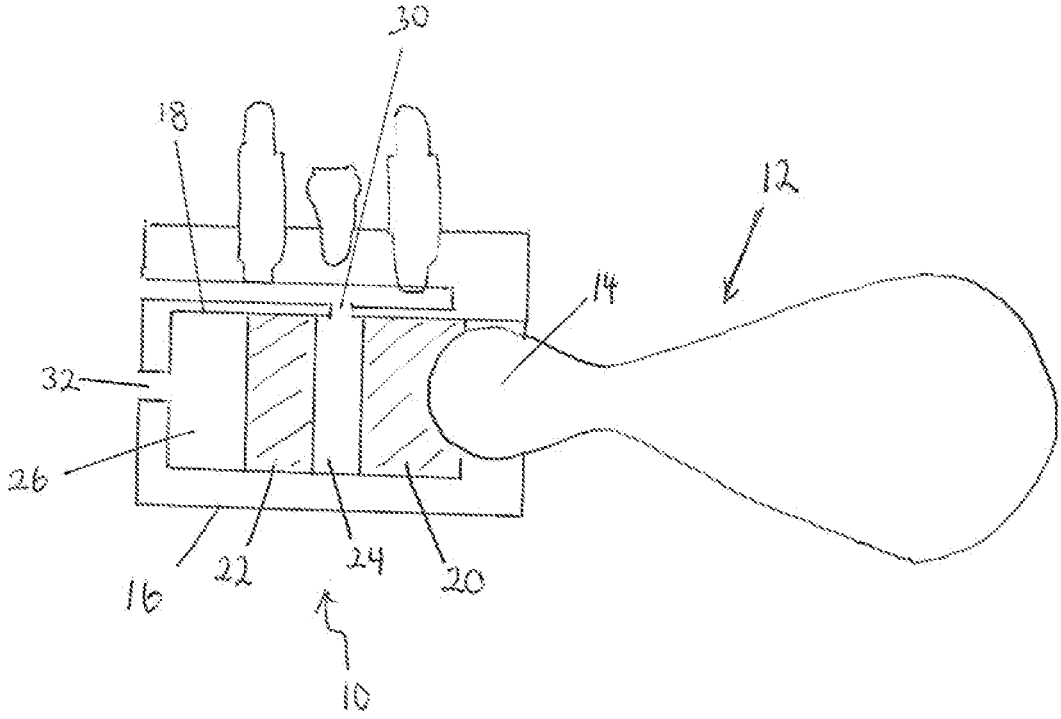
FIG. 1 is a cross sectional side view of a cylinder unit containing the piston unit described herein.

The piston unit is shown in FIG. 1 and is indicated generally at numeral 10. The piston unit 10 is connected to a common driveshaft 12 through one end of a connecting rod 14.

The piston unit 10 includes a main body, indicated generally at 16. Within the main body 16 the piston unit 10 includes a first piston 20 and a second piston 22 that define a first cavity 24 between them. Located between the second piston 22 and the main body 16 is a second cavity 26.

In use, when in brake mode, the rotational motion of the driveshaft 12 is transferred to reciprocating motion of the first piston 20 via the connecting rod 14. When in drive mode, the reciprocating motion of the first piston 20 is transferred to rotational motion of the driveshaft 12.

Figure 2:
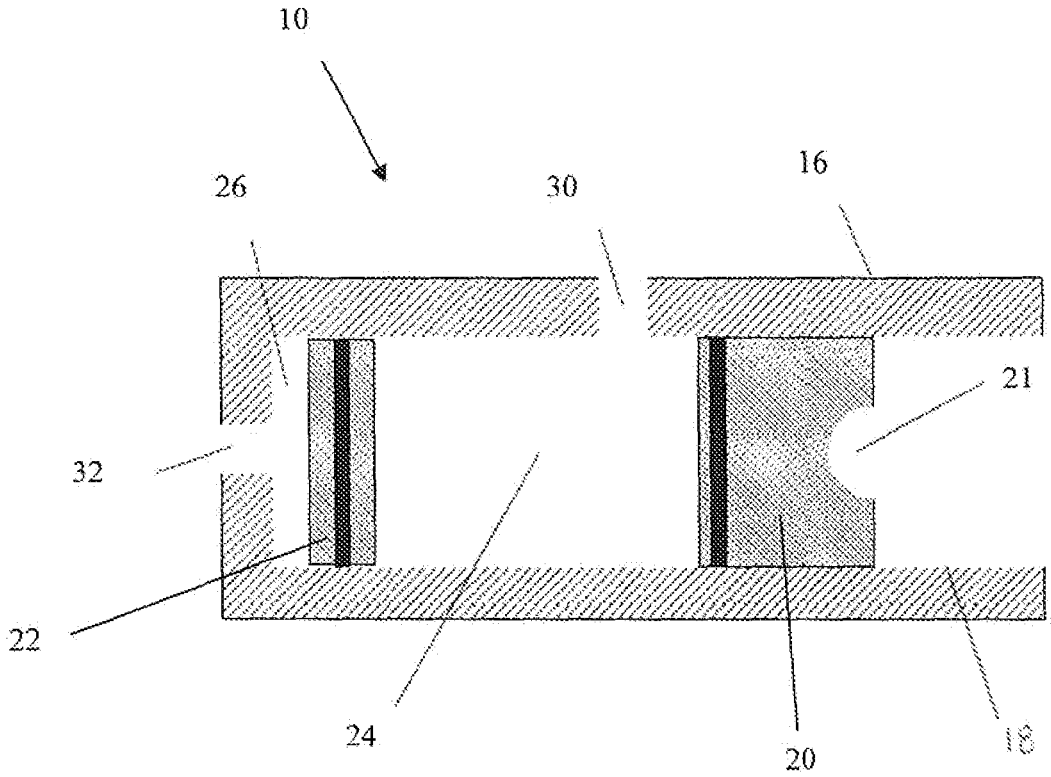
FIG. 2 is a schematic of one embodiment of the piston unit described herein.

Turning to FIG. 2, the piston unit 10 is shown in more detail. The main piston 20 includes a first surface 21 that is operable to connect with a driveshaft 12, as shown in FIG. 1. In the illustrated embodiment, the first surface 21 is shaped to receive a spherical end of the connecting rod 14 of the driveshaft 12. However, it will be understood that other well known bearing mechanism that provide for the transfer of power between the connecting rod 14 and the first piston 20 and that allows for the first piston 20 to decouple from the connecting rod 14.

The main body 16 of the piston unit 10 includes a central bore 18 within which the first and second pistons 20, 22 are located and are operable to reciprocate. The main body 16 also includes a first opening, or passageway, 30 that allows for fluid to pass into and out of the first cavity 24, and a second opening or passageway 32, that allows for air to pass into and out of the second cavity 26.

In one embodiment of the piston unit 10, the first cavity 24 is operable to receive hydraulic fluid that flows in and out of first opening 30. The second cavity 26 is operable to receive a resilient element therein. The resilient element may be any element that is operable to convert kinetic energy to potential energy and vice versa. Examples of resilient elements that may be used include a spring. The resilient element may be a compressible medium such as an air bag or a gas, such as nitrogen, that will then be contained within a closed container. In this embodiment, the second opening 32 will be closed to contain the resilient element within the second cavity 26. In another embodiment, the resilient element may be connected to an external resistance control element, not shown, such as, for example, a source of compressed air, that can adjust the resilient element to the movement of the second piston 22. In this embodiment, it will be understood that second opening 32 will be operable to open and close to allow for passage of the resilient element through the second opening 32 into the second cavity 26, as required.

In an alternative embodiment of the present invention, the configuration of the first and second cavity 24, 26 are reversed. In other words, the first cavity 24 is operable to receive a resilient element therein and the first opening 30 is operable to allow for the flow of a resilient element into and out of the first cavity 24. In the embodiments in which the resilient element is self contained within the first cavity 24, as described above in relation to the second cavity 26, then the first opening 30 is closed. When a resilient element is located within the first cavity 24, the second cavity 26 is operable to receive a fluid therein which flows into and out of the second cavity 26 via second opening 32.

The operation of the first embodiment of the piston unit 10 will now be described in relation to FIGS. 3 through 5. The first embodiment includes the piston unit 10 having a fluid source, such as hydraulic fluid, located within the first cavity 24 and operable to flow in and out of the first cavity 24, and a resilient element located within the second cavity 26. For the purposes of this description, resilient element is a source of compressible gas that is self contained within the second cavity 26 and second opening 32 is closed. However, it will be understood that from the description provided above, that other embodiments of the resilient element may be used, including have a resistance control unit that controls the resistance of the resilient element via second opening 32.

Figure 3:
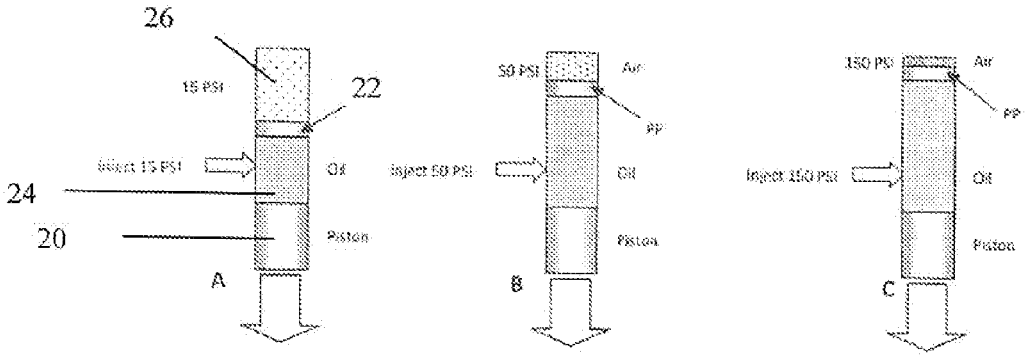
FIGS. 3A-C are schematic diagrams showing the oil injection phase for one embodiment of the piston unit described herein.

Turning to FIG. 3, an oil injection phase for the piston unit 10 is shown. For ease of reference only the internal components of the piston unit are shown, i.e. the first piston 20, second piston 22, first cavity 24 and second cavity 26. For the purposes of this description an assumption is made that an initial air charge of 15 PSI is trapped within the second cavity 26, i.e. the resilient element located in second cavity 26 is air at 15 PSI.

As the first piston 20 descends, fluid, in this example oil, is injected into the first cavity 24 and fills the first cavity 24 that is increasing in size due to the receding first piston 20.

Turning to FIG. 3A, when the first piston 20 moves down from Top Dead Centre (TDC), injection pressure opens the first opening 30, not shown in FIG. 3, to allow oil to be injected into the first cavity 24. If an oil injection pressure of 15 PSI is applied then the first cavity 24 will fill without displacing the second piston 22, due to the counter balance of the air (15 PSI) in the second cavity 26.

When the first piston 20 reaches Bottom Dead Centre (BDC), the fluid volume that has been injected into first cavity 24 is assumed to be 1.0 unit.

FIG. 3B shows a fluid injection pressure of 50 PSI. When fluid is injected at this pressure, the pressure in first cavity 24 overcomes the air pressure in the second cavity 26 and moves the second piston 22 away from the first piston 20, compressing the air that is located within the second cavity 26, to a balancing 50 PSI. At the same time the first piston 20 descends within central bore 18 which provides a greater available volume in first cavity 24. Once the first piston 20 reaches BDC the total injected fluid volume is 2.0 units.

FIG. 3C shows an injection pressure of 150 PSI. As the fluid is injected into first cavity 24 the pressure of the fluid moves the second piston 22 away from the first piston 20 towards the end of the cylinder bore 18 reducing the size of second cavity 26 and compressing the air further to $1/10^{th}$ of its original volume. This allows additional oil to be injected into first cavity 24. Once the first piston 20 has reached BDC in this scenario, the volume of fluid injected into first cavity 24 is 3.0 units.

As can be seen from FIGS. 3A to 3C the total volume of oil, or fluid, that can be injected into the first cavity 24 is a function of the initial injection pressure. The higher the injection pressure the larger volume of injected oil. While the FIGS. 3A-3C do not specifically show the first and second openings, it will be understood that they are present as described above.

Turning to FIGS. 4A through C, the oil ejection phase, under low pressure, is described.

In the scenario described above in which 15 PSI of injection pressure was used, we will assume, for the purposes of this example, that the pump works into a head pressure of 1000 PSI.

As the upward stroke commences, i.e. as the first piston 20 moves upwards as a result of the interaction with the driveshaft, the fluid located in first cavity 24 is moved upwards towards the second piston 22 and the resilient element, i.e. air, in second cavity 26 is compressed by the second piston 22. As the first piston 20 approaches TDC, shown in FIG. $4A_1$, the fluid located within first cavity 24 does not reach the required 1000 PSI to allow for the fluid to pass out of first opening 30, not shown, and no ejection of the oil occurs. The pump delivery will be zero and any energy absorbed compressing gas, will be elastically returned on the successive downstroke, thereby no net energy will be absorbed from the pump shaft.

Figure 4:
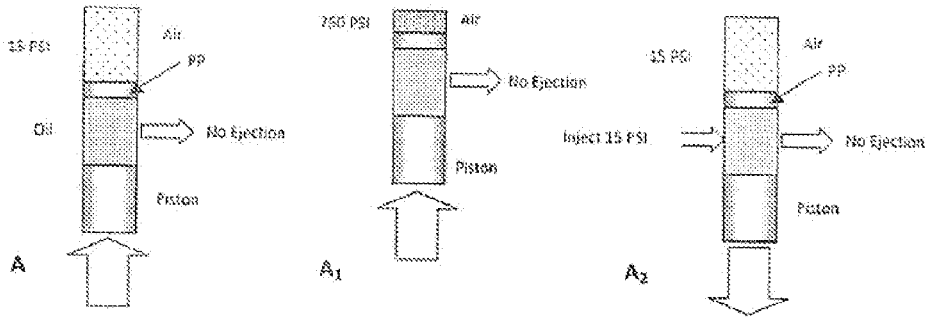

During the ensuing downstroke, shown in FIG. 4$A_2$, no new oil is injected into first cavity 24 because the resilient element in the second cavity 26 merely re-expands as the first piston 20 moves away from TDC. As can be seen in FIGS. 4A-$A_2$, in this low injection mode the passive air volume, i.e. resilient element, behaves as a spring-loaded buffer that can carry over oil from one stroke to the next while preventing a vacuum within the system.

Figure 5:
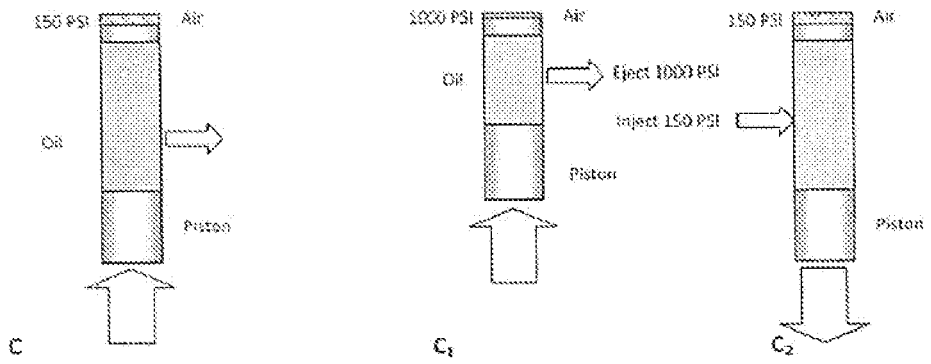

Turning now to FIGS. 5C-5$C_2$, the oil ejection under high injection pressure phase is shown.

In this scenario an initial injection pressure of 150 PSI is used and the pump is working into a head of 1000 PSI. As the upward stroke commences, shown in FIG. 5C, and the first piston 20 moves away from BDC, the resilient element, or air, located in second cavity 26 is compressed further. However, since the initial 150 PSI of injection pressure has already driven the second piston 22 to 90% of its available stroke, it will only require a small additional piston travel to raise the pressure to 1000 PSI which will be sufficient to initiate ejection of the oil from the first cavity 22 through the first opening 30, not specifically shown.

As the first piston 20 continues to rise, the oil is continuously ejected out of the first opening 30 at 1000 PSI. When the first piston 20 reaches TDC the pump has delivered approximately 97% of its theoretical displacement. Work has been performed and energy has been absorbed from the pump shaft.

During the ensuing downstroke, shown in FIG. 5$C_2$, the resilient element, or air, located in second cavity 26, re-expands which drops the pressure from 1000 PSI to the initial 150 PSI which restores the piston unit 10 to its initial state. Once this differential is absorbed, the second piston 22 effectively remains pinned upward at 90% of its stroke due to the continual injection of oil into the first cavity 24 at 150 PSI. As the oil continues to be injected into the first cavity 24 and the first piston 20 continues to travel towards BDC, the volume of the first cavity 24 increases allowing more oil to fill it. In this high pressure injection mode, the resilient element will maintain only small volumetric changes from one rotational cycle to the next.

As can be seen from the description provided above, the piston unit 10, allows for pump flow to be varied from 0 to 100% through modulation of the injection pressure from 15 to 150 PSI, for example. Injection pressure between the two values will result in pump flows roughly proportional to injection pressures. In addition to the flow control, pressure control valves may be used in the hydraulic fluid output that can simultaneously control the pressure head seen by the pump.

It will be understood that the work performed by the brake is the product of flow and working head (PSI). This combined modulation technique easily delivers seamless control with a high (1000:1) turndown ratio which is a requisite for vehicle braking.

In an alternative embodiment, the location of the fluid and the resilient member are reversed and the resilient element will be received within the first cavity 24 and the fluid will be received within the second cavity 26. In this scenario, resilient element is located within first cavity 24 at a predetermined pressure. Fluid, e.g. oil, is injected at a predetermined pressure into the second cavity 26.

Figure 6:
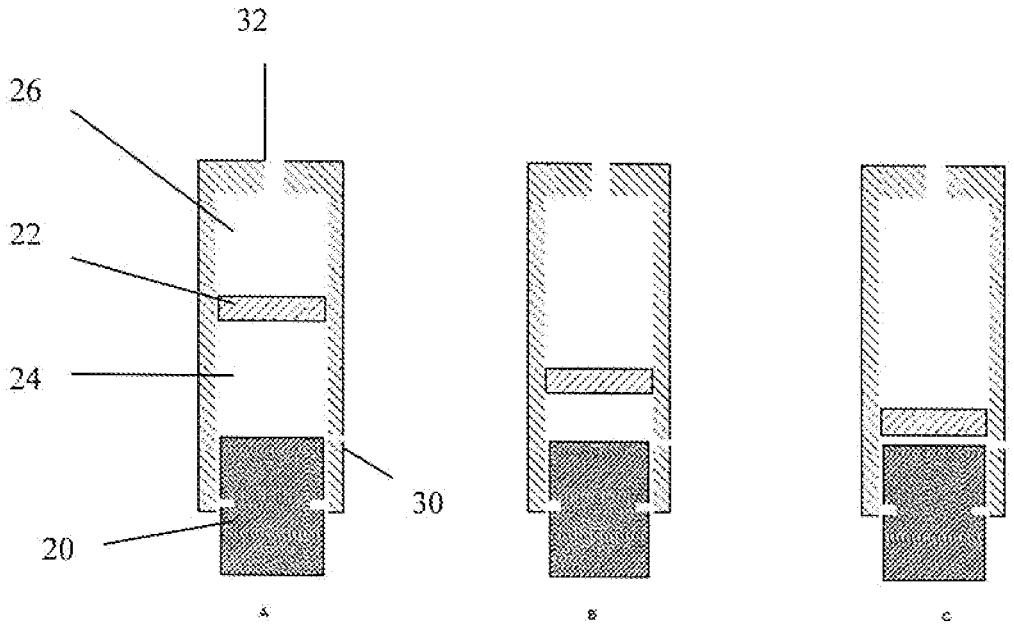
FIGS. 6A-C show the oil injection phase for an alternative embodiment of the piston unit described herein.

The scenario discussed above with respect to FIG. 3A-3C, will now be discussed with reference to FIGS. 6A-6C. An initial air pressure of 15 PSI in the first cavity 24 and an initial injection pressure of oil in the second cavity 26 will result in a static system with both cavities balancing each other in pressure. In the situation where the oil is injected at 50 PSI, as shown in FIG. 6B, and the first piston 20 is moving away from TDC, the pressure from the injected oil will move the second piston 22 towards the first piston 20 compressing the air located within the first cavity 24. The first piston 20 will move towards BDC as the second piston 22 moves towards the first piston 20 allowing for more oil to flow into the second cavity 26.

Figure 7:
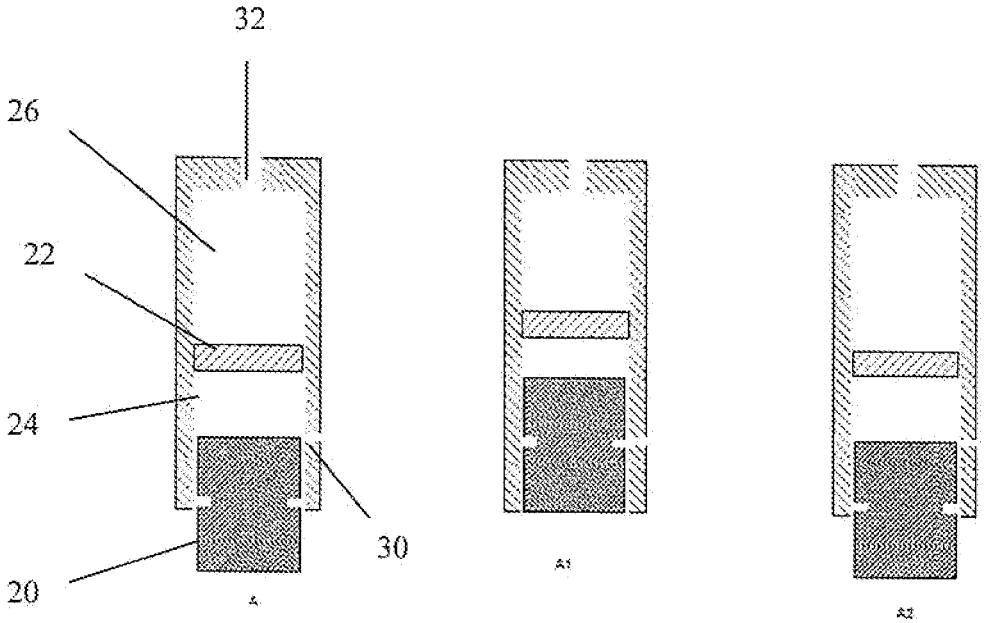
FIGS. 7A-$A_2$ show the oil ejection phase under low injection pressure for an alternative embodiment of the piston unit described herein.

In the scenario where there is a 15 PSI injection pressure, see FIGS. 7A-$A_2$, and the pump is working into a head pressure of 1000 PSI the following occurs. On the ascent of the first piston 20, the compressible medium, i.e. the air, will be crushed as the first piston 20 moves towards the second piston 22 which cannot move within the central bore 18 due to the pressure of the fluid located in the second cavity 26. As the first piston 20 moves towards the second piston 22 the air is compressed in the first cavity 24, see FIG. 7$A_1$. No oil is ejected because the required 1000 PSI is not reached. On the ensuing downstroke, the air re-expands within first cavity 24, see FIG. 7$A_2$.

Figure 8:
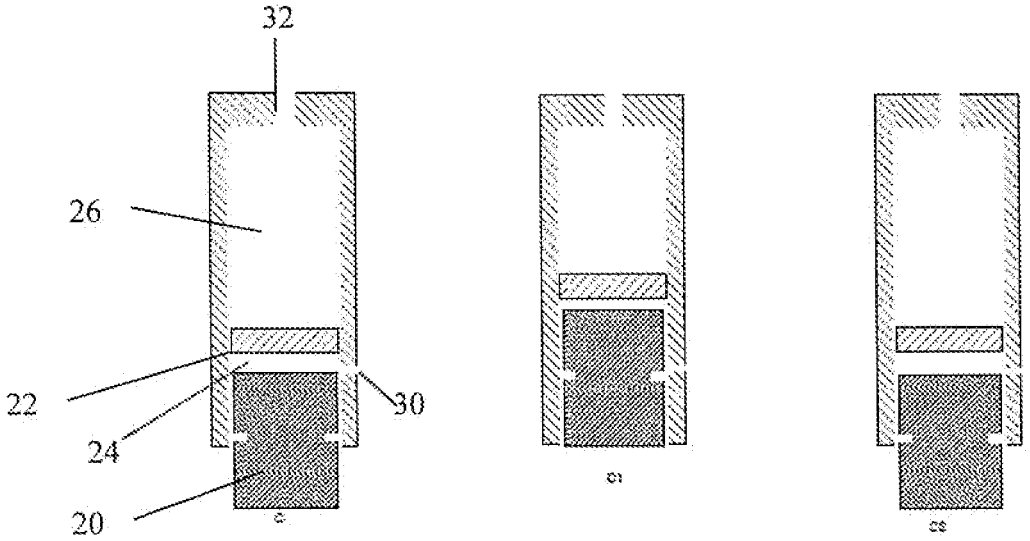
FIGS. 8C-$C_2$ show the oil ejection phase under high injection pressure for an alternative embodiment of the piston unit described herein.

When an injection pressure of 150 PSI is used, as described above for FIGS. 5C-5$C_2$, oil has been injected into second cavity 26 and the air is compressed within first cavity 24, see FIGS. 8C-$C_2$. As the first piston 20 moves away from BDC, driven by the driveshaft, the compressed air in first cavity 24 is further compressed. As described above, since the initial 150 PSI of injection pressure has already driven the second piston 22 to 90% of its available stroke, it will only require a small additional piston travel to raise the pressure to 1000 PSI which will be sufficient to initiate ejection of the oil from the second cavity 26 through the second opening 32, shown in FIG. 8$C_2$.

Figure 9:
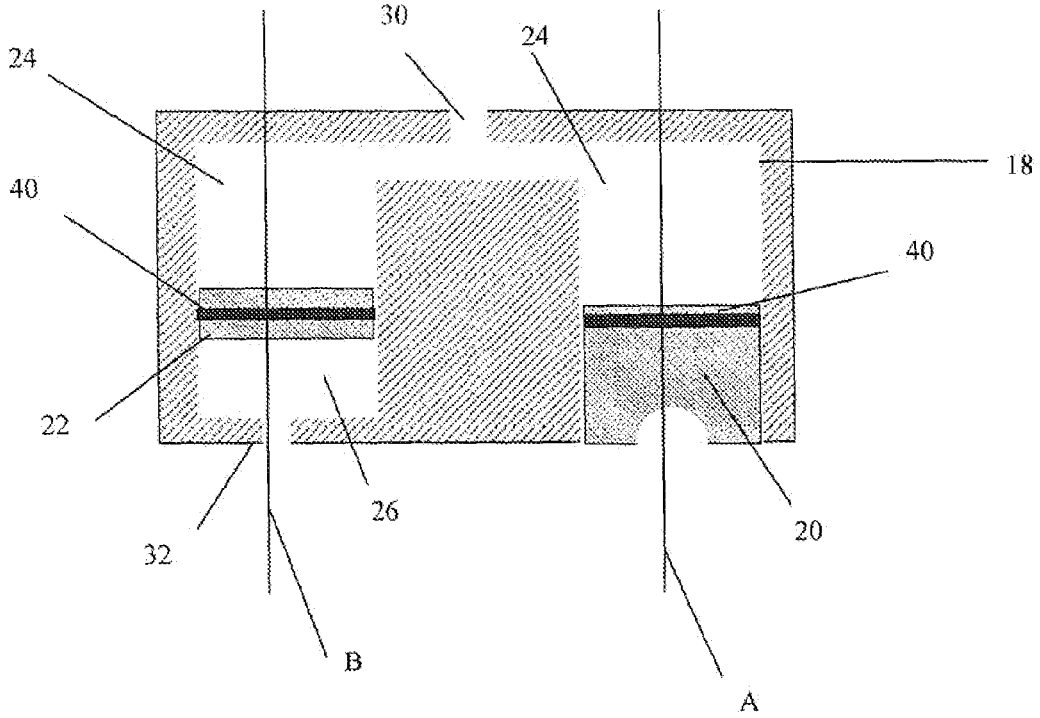
FIG. 9 is a schematic of an alternate embodiment of the piston unit described herein.

Turning to FIG. 9 an alternative embodiment of the piston unit 10 described herein is shown. In this embodiment, the piston unit 10 includes first and second pistons 20, 22 in a side by side configuration. The piston unit 10 includes a central bore 18 that is operable to receive the first piston 20 and the second piston 22, both of which are operable to reciprocate within the central bore 18. The central bore is U-shaped (or n-shaped in the attached figure) and includes several turns within it. Each of the first and second pistons 20, 22 are operable to reciprocate within the bore along an axis. First piston 20 reciprocates within central bore 18 along axis A and second piston reciprocates within central bore 18 along axis B. As can be seen in FIG. 9, axis A is parallel to axis B.

Defined between the first and second pistons 20, 22 is a first cavity 24 and located on the opposite side of the second piston 22 from the first cavity 24, is the second cavity 26. In the Figure shown, the first cavity 24 extends around a corner within the central bore 18, however it will be understood that the volume of the first cavity will change during operation of the piston unit 10, as described herein. It will be understood that the location of the first and second openings, may differ from the position shown in the attached Figures, for example the first opening 30 may be located off centre compared to that illustrated in FIG. 9.

In one embodiment of the piston unit 10 shown in FIG. 9, the first cavity 24 is operable to receive fluid and the second cavity 32 is operable to receive a resilient element. In another embodiment of the piston unit 10, shown in FIG. 9, the first cavity is operable to receive a resilient element and the second cavity is operable to receive fluid.

Figure 10:
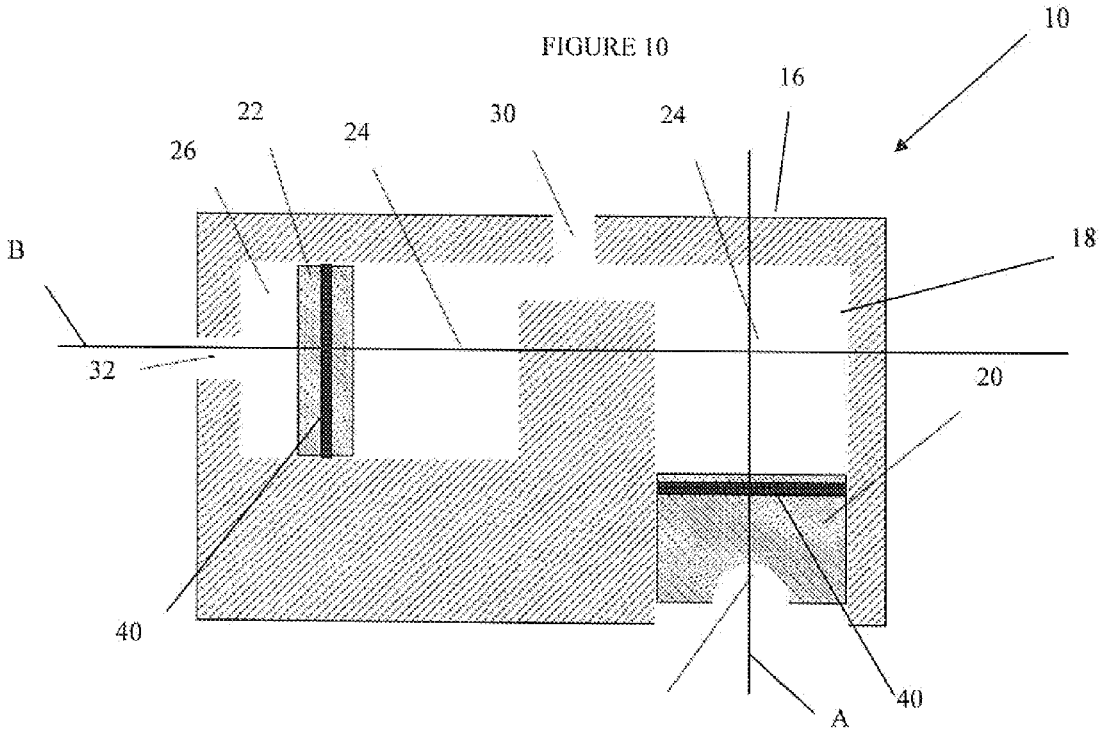
FIG. 10 is a schematic of a further embodiment of the piston unit described herein.

Turning to FIG. 10 an alternative embodiment of the piston unit 10 is shown with the piston unit 10 including a main body 16 having a central bore 18. In this embodiment the pistons 20, 22 are operating at a 90° angle to each other. The operation of the piston unit 10 is still, as per the above description. As can be seen in FIG. 10, first piston 20 reciprocates within central bore 18 along axis A and second piston 22 reciprocates within central bore 18 along axis B. Axis A and axis B are in a non-parallel configuration, and in fact are located at 90° relative to each other.

Each of the first piston 20 and the second piston 22 may also include a piston seal, indicated generally in FIGS. 9 and 10 at numeral 40. The piston seal 40 is operable to trap gas within the first or second cavity 30, 32 that contains gas, when used as the resilient element, to inhibit bleed through into the other of the first and second cavity 30, 32 that contains hydraulic fluid.

While this invention has been described with reference to illustrative embodiments and examples, the description is not intended to be construed in a limiting sense. Thus, various modification of the illustrative embodiments, as well as other embodiments of the invention, will be apparent to persons skilled in the art upon reference to this description. It is therefore contemplated that the appended claims will cover any such modifications or embodiments. Further, all of the claims are hereby incorporated by reference into the description of the preferred embodiments.

Any publications, patents and patent applications referred to herein are incorporated by reference in their entirety to the same extent as if each individual publication, patent or patent application was specifically and individually indicated to be incorporated by reference in its entirety.

We claim:

1. A piston unit comprising:

a main body having a bore located therein, the bore having a first end and a second end;

a first piston, received within the bore and operable to reciprocate therein;

a second piston, received within the bore between the first piston and the second end of the bore, the second piston being operable to reciprocate within the bore, the second piston and the second end of the bore defining a first cavity therebetween and the first and second piston defining a second cavity therebetween; and a resilient element, located in one of the first cavity and the second cavity, the resilient element operable to bias the second piston towards the first piston when located in the first cavity and operable to bias the second piston away from the first piston when located in the second cavity;

wherein the bore has a non-linear configuration.

2. The piston unit of claim 1, wherein the other of the first cavity and the second cavity is configured to receive pressurized hydraulic fluid through a fluid port located therein.

3. The piston unit of claim 1, wherein the resilient element is connected to a resilience control unit for varying the resistance of the resilient element.

4. The piston unit of claim 1, wherein the resilient element is a compressible medium that is operable to convert kinetic energy to potential energy.

5. The piston unit of claim 1, wherein the resilient element is a spring.

6. The piston unit of claim 1, wherein each of the first and second pistons reciprocate along axes that are parallel to each other.

7. A piston unit comprising:

a main body having a bore located therein, the bore having a first end and a second end;

a first piston, received within the bore and operable to reciprocate therein;

a second piston, received within the bore between the first piston and the second end of the bore, the second piston being operable to reciprocate within the bore, the second piston and the second end of the bore defining a first cavity therebetween and the first and second piston defining a second cavity therebetween; and a resilient element, located in one of the first cavity and the second cavity, the resilient element operable to bias the second piston towards the first piston when located in the first cavity and operable to bias the second piston away from the first piston when located in the second cavity;

wherein first piston reciprocates along a first axis within the bore and the second piston reciprocates along a second axis within the bore, the first and second axis are non-parallel.

8. The piston unit of claim 1, wherein the first piston and the second piston are configured to both move towards the first cavity containing the resilient element to result in compressing of the resilient element.

9. The piston unit of claim 1, wherein the first piston and the second piston are configured to both move in opposite directions with respect to the first cavity containing the resilient element to result in compressing of the resilient element.

10. The piston unit of claim 7, wherein the first and second axis are at 90° relative to each other.

11. The piston unit of claim 7, wherein the first piston and the second piston are configured to both move towards the first cavity containing the resilient element to result in compressing of the resilient element.

12. The piston unit of claim 7, wherein the first piston and the second piston are configured to both move in opposite directions with respect to the first cavity containing the resilient element to result in compressing of the resilient element.

13. The piston unit of claim 7, wherein the resilient element is connected to a resilience control unit for varying the resistance of the resilient element.

14. The piston unit of claim 7, wherein the resilient element is a compressible medium that is operable to convert kinetic energy to potential energy.

15. The piston unit of claim 7, wherein the resilient element is a spring.

* * * * *